United States Patent [19]

Fieber et al.

[11] 4,447,686

[45] May 8, 1984

[54] PUSHBUTTON SWITCH OR PUSHBUTTON-ACTUATED SLIDE SWITCH

[75] Inventors: Werner H. Fieber; Klaus Hinze; Manfred K. O. Huth; Hans-Georg Jost; Klaus D. Lamm; Dieter Michalski; Konstantin Rittaler, all of Berlin, Fed. Rep. of Germany

[73] Assignee: ITT Industries, Inc., New York, N.Y.

[21] Appl. No.: 447,202

[22] Filed: Dec. 6, 1982

[30] Foreign Application Priority Data

Dec. 10, 1981 [DE] Fed. Rep. of Germany ..... 3148855

[51] Int. Cl.[3] ..... H01H 9/26; H01H 9/20

[52] U.S. Cl. ..... 200/153 J; 200/328; 200/5 EA; 200/325

[58] Field of Search ..... 200/5 E, 5 EA, 5 ED, 200/153 J, 328, 323, 324, 325

[56] References Cited

U.S. PATENT DOCUMENTS

| | | | |
|---|---|---|---|
| Re. 27,836 | 12/1973 | Hansen | 200/153 J X |
| 3,187,602 | 6/1965 | Cousins | 200/153 J |
| 3,783,204 | 1/1974 | Kennedy et al. | 200/5 EB |
| 3,970,806 | 7/1976 | Distler | 200/328 |
| 4,013,855 | 3/1977 | Reichen et al. | 200/153 J X |
| 4,095,059 | 6/1978 | Nishioka et al. | 200/5 E |
| 4,242,544 | 12/1980 | Schweitzer | 200/5 E |

FOREIGN PATENT DOCUMENTS

| | | | |
|---|---|---|---|
| 2417330 | 11/1975 | Fed. Rep. of Germany . | |
| 2622229 | 12/1977 | Fed. Rep. of Germany | 200/153 J |
| 2653372 | 12/1978 | Fed. Rep. of Germany . | |
| 2926824 | 1/1981 | Fed. Rep. of Germany . | |

*Primary Examiner*—Stephen Marcus
*Assistant Examiner*—Ernest G. Cusick
*Attorney, Agent, or Firm*—James B. Raden; William J. Michals

[57] ABSTRACT

In a pushbutton switch or pushbutton-actuated slide switch having a detent mechanism designed to have the shape of a heart cam, an individual latching and a mutual unlatching is made possible in that, according to the invention, the heart cam is provided with a further, center curved path for the unlatching (disengaging) purpose. Within this area of the position of the detent pin, the latching is accomplished by a cross slide which, during the off-switching process, can be pressed via a limit stop and by the detent pin into the unlatching (disengaging) position.

1 Claim, 9 Drawing Figures

PUSHBUTTON SWITCH OR PUSHBUTTON-ACTUATED SLIDE SWITCH

BACKGROUND OF THE INVENTION

The present invention relates to a pushbutton switch or pushbutton-actuated slide switch which is capable of being engaged and disengaged by means of a heart cam comprising an engaging and disengaging curved path, and an engaging pin which is capable of being laterally deflected and longitudinally displaced in relation thereto, and is capable of being combined with further switches, in particular of the same type, to form a pushbutton assembly.

Switches comprising these conventional heart cams serving as detent means, are designed as individual pushbuttons with individual release for the on-off switching and may be combined to form pushbutton assemblies.

Pushbutton switches or pushbutton-actuated slide switch assemblies are also known, in which the individual pushbutton switches, if so required, are capable of being engaged and disengaged either individually or in common with the aid of a common disengaging rail or engaging flap. In this way several pushbutton keys can be depressed simultaneously or one at a time in turn, and quite depending on the detent mechanism, either several or all pushbuttons can be released simultaneously either by a special key or by one of the other keys.

It is the object of the present invention, amongst others, to design switches with heart cams as detent means, in such a way that these switches can be used as pushbuttons with an individual engagement, and can also be designed in such a way that several can be switched simultaneously, in particular of being disengaged simultaneously.

SUMMARY OF THE INVENTION

This object is achieved in that the heart cam is provided with a second, central disengaging curved path extending from the detent or engaging position to the zero position. Owing to this embodiment of the heart cam, the pushbutton switch or pushbutton-actuated slide switch can be used at first as a "non-locking type" pushbutton switch, because by the additional disengaging curve is not yet enabled an engagement. According to an advantageous further embodiment of the invention, the switch is provided with a detent member, e.g., in the form of a detent rail, which is capable of being actuated by a detent profile capable of being displaced as well during the pushbutton actuation, and is capable of retaining the switching slide in the detent position. On account of this additional measure, the switch according to the invention can be used as a single-release switch or else, when the detent member is capable of being actuated by other means, such as by other switches, for effecting a group release. By the entirety of these measures, therefore, the novel switch can be used very universally either as a non-locking pushbutton switch or as a switch suitable for individual or group release without any alterations having to be carried out on the switch itself.

BRIEF DESCRIPTION OF THE DRAWINGS

Further advantageous details of the invention will now be described hereinafter with reference to an example of embodiment shown in FIGS. 1 to 6 of the accompanying drawings, in which.

DETAILED DESCRIPTION

Figure 1:
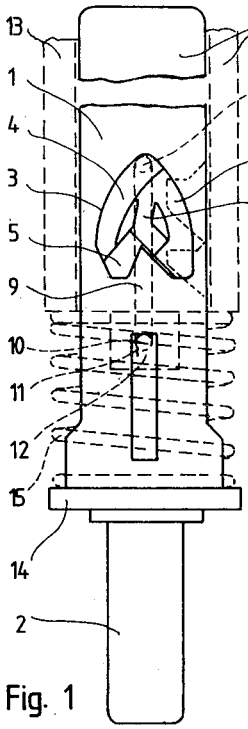
FIG. 1, in a top view, shows a switch slide designed in accordance with the invention, in a simplified representation, without contacts, with the housing thereof merely being denoted by the dashlines.

In FIG. 1, the reference numeral 1 indicates a switch slide of a pushbutton switch or pushbutton-actuated slide switch, onto the finger 2 of which a not shown pushbutton keytop is capable of being placed. The surface of the switch slide 1 is provided with a heart cam 3, in the curved paths 4, 5, 6 and 7 of which a detent pin 8 is guided. The latter consists of a wire member 9 whose one end is the detent pin 8 and whose other end serves as the hold pin 10. In the example of embodiment, this hold pin 10 is pivotally mounted in an opening 11 of an extension 12 of the housing 13. Between the housing 13 and a stop plate 14 of the switch slide 1 there is clamped a return spring 15. With some of its turns, this return spring 15 presses simultaneously upon the wire member 9, so that the detent pin 8 is resiliently applied to the bottom of the curved paths of the heart cam.

Figure 2:
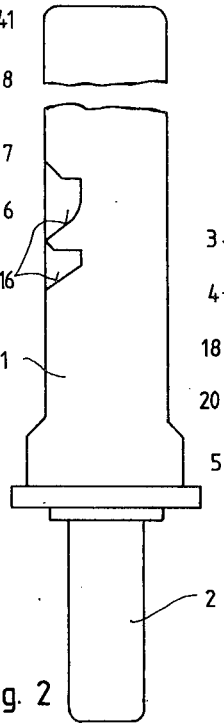
FIG. 2 shows the bottom side of the switch slide according to FIG. 1.
Figure 4:
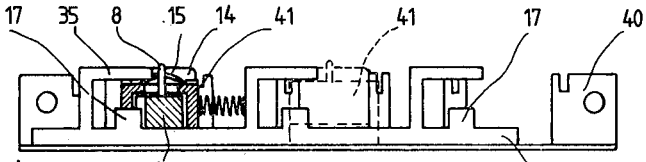
FIG. 4 is the sectional side view of a switch inserted into a frame of a pushbutton assembly.
Figure 5:
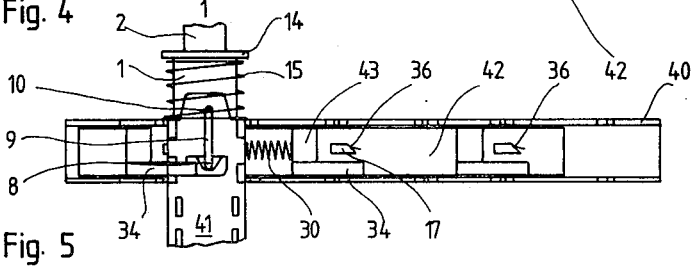
FIG. 5 shows the arrangement of FIG. 4 in a top view.

The bottom side of the switch slide 1 as shown in FIG. 2, is provided on its side with a detent profile 16 which cooperates with a detent member designed to have the shape of a detent rail or bar 17, as is particularly shown in FIGS. 4 through 6.

Figure 3:
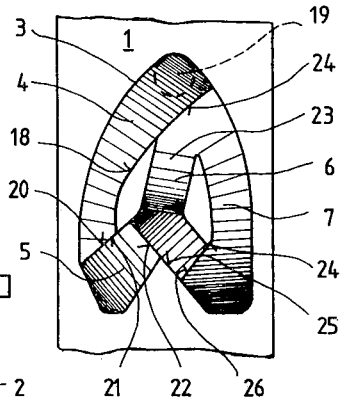
FIG. 3 shows the heart cam on an enlarged scale.

According to the invention, the heart cam 3 is provided with an additional central disengaging curved path 6. This will now be explained in greater detail with reference to FIG. 3. The crosslines in the curved paths 4, 5, 6 and 7 are indicative of the respective position thereof in a vertical sense. The nearer the crosslines are to one another, i.e., the darker the path appears, the lower is the bottom thereof. The curved path of the heart cam 3 consists of a first curved-path section 4 with a sliding edge 18 along which the detent pin 8, upon depressing the switch slide 1, can be slowly lifted from the zero position 19 thereof until it, via the final edge 20 of the curved path 4, drops downwardly upon the engaging curved path 5. Upon letting go the switch slide 1, the detent pin 8 is moved along the sliding edge 21 of the engaging curved path 5, is lifted thereby and slips over the final edge 22 of the engaging curved path 5 onto the central disengaging curved path 6 as arranged according to the invention. In the course of the further return movement of the switch slide 1, the detent pin 8 slides along the slidings edge 23 of the disengaging curved path 6, is lifted thereby and, via the upper final edge 24, drops into the curved path 4 and, consequently back to the zero or initial position 19.

When the switch slide 1, after the detent pin 8 has jumped over the final edge 22, is further moved in the sliding direction, it will slide along a second sliding edge 25 of the disengaging curved path 6, and, via the lower final edge 26 of the curved path 6, will drop onto the outer disengaging path 7. When the switch slide 1 is moved in the backward direction, the detent pin 8 slides along the sliding surface 27 of the outer disengaging curved path 7, is lifted within this curved path and, via the upper final edge 24 which is common to the central disengaging curved path 6, is brought onto the curved path 4 and into the zero position 19.

In this form, the switch is capable of being used as a non-locking pushbutton switch, because there is not effected any locking of the detent pin 8, and because the latter only passes through the curved paths 4, 5 and 6.

The possible individual and group release will now be described hereinafter with reference to FIGS. 6*a* through 6*d*.

Figure 6A:
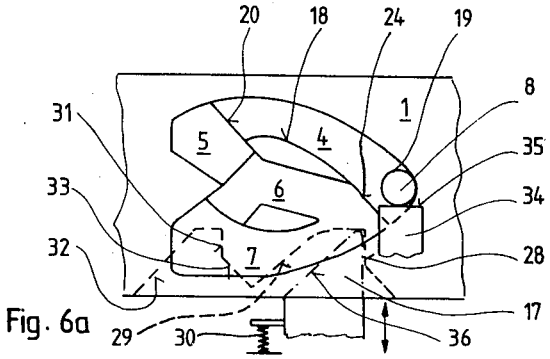
FIGS. 6*a* to 6*d* show the various operating positions of the heart cam together with an associated detent rail.

FIG. 6*a* shows the switch slide 1 in the non-depressed position. The detent pin 8 is in its zero or initial position 19. By way of its stop edge 28, the detent slide 17 cooperates with the detent profile 16. The detent slide 17 can be displaced vertically in relation to the sliding direction of the switch slide 1 by means of a first slanting run-up surface 29 in opposition to the action of a spring 30, hence in the drawing, in the downward direction. The detent profile 16 still has a detent surface 31 lying within the range of action of the detent rail 17, and a second slanting run-up surface 32, as well as a disengaging surface 33.

To the detent slide 17 there is rigidly coupled a stop 34 which may also form one structural unit therewith. The end of the stop is designed as a pressure surface 35. In the zero position 19, this surface comes to lie close to the detent pin 8.

In order to avoid a high surface pressure at the slanting run-up surfaces 29 and 32, the detent slide 17 can be preferably provided with an edge 36 extending parallel in relation thereto.

Figure 6B:
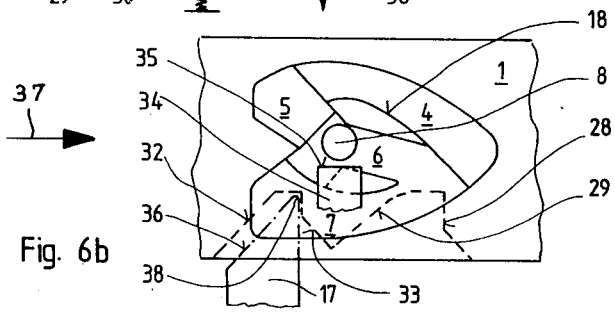

The mode of operation of this arrangement according to the invention is as follows:

When the switch slide 1 is actuated from the position as shown in FIG. 6*a* in the direction as indicated by the arrow 37 as shown in FIG. 6*b*, the detent pin 8 moves along the sliding edge 18 over the final edge 20 onto the engaging curved path 5. At the same time, the slanting run-up surface 29 cooperates with the edge 36 of the detent slide 17 and displaces the latter in the downward direction. Subsequently thereto, it slides with its pointed end 38 along the disengaging edge 33, slips onto the detent surface 31 and finally comes into an operative connection with the second slanting run-up surface 32.

If now, under the action of the return spring 15, the switch slide 1 is permitted to slide back, it hits the detent slide 17 with its pointed end 38 against the detent surface 31 and retains the switch slide 1 in the detent position. In the course of this, the detent pin 8 slips from the engaging curved path 5 via the final edge 22 onto the disengaging curved path 6. At the same time, by the displacement of the detent slide 17, the pressure surface 35 is always carried along in such a way that it will not affect the movement of the detent pin 8.

If, in this position as shown in FIG. 6*b*, the detent slide 17, by actuating another pushbutton switch or any other suitable means, is moved in the downward direction until it slips out of the detent effect of the detent surface 31 of the detent profile 16, then the switch slide 1, owing to the force of the return spring 15, will slide back to normal, because the detent pin 8, along the disengaging curved path 6 and via the final edge 24, is capable of sliding into the initial (zero) position 19, in the course of which the pointed end 38 of the detent slide 17 slides along the disengaging edge 33 and is pressed by the latter in the downward direction until it, if so required, and along the detent profile 16, meets against the stop edge 28. This is the mode of operation in the case of a foreign or group release.

Figure 6C:
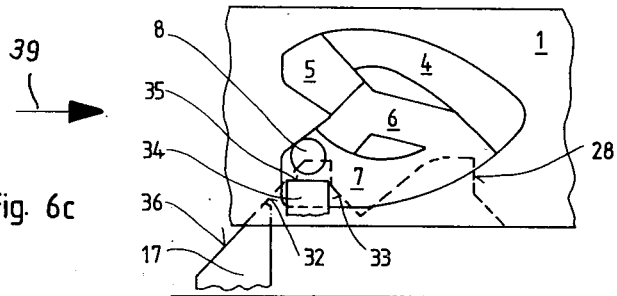
Figure 6D:
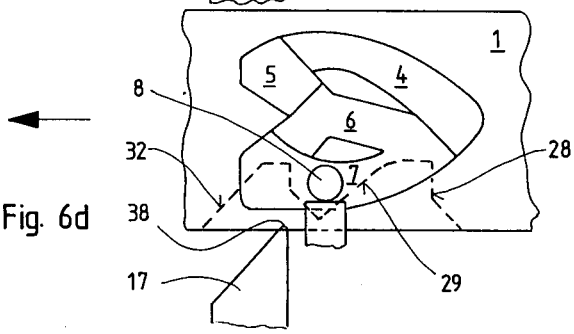

If no external or foreign release is effected in the position as shown in FIG. 6*b*, the switch slide 1, by being repeatedly depressed in the direction as indicated by the arrow 39 in FIG. 6*c*, can be actuated in the over-travel. In the course of this, the detent slide 17 and the pressure surface 35, by cooperating with the slanting run-up surface 32, are displaced in the downward direction. At the same time, the detent pin 8 slides along the sliding edge 25 over the upper final edge 26 of the central disengaging curved path 6, onto the outer disengaging curved path 7. This position is shown in FIG. 6*c*. When letting go the switch slide 1, the latter is capable of sliding into its normal position owing to the resetting force of the return spring 14. This is accomplished in that at first the detent slide 17 slides in the upward direction, i.e., until the stop 34 presses with its pressure surface 35 against the detent pin 8, thus pushing the latter against the sliding surface 27. Subsequently thereto, the detent pin 8 slides along the sliding surface 27 (FIG. 6*d*) to the zero position 19, thus pressing the detent slide continuously in the downward direction. This slide 17, therefore, is prevented from coming into an operative connection with the detent surface 31, so that a locking thereof is no longer possible. In this way, the initial position as shown in FIG. 6*a* is reached again.

FIG. 4 shows the U-shaped frame 40 of a pushbutton assembly comprising an inserted switch 41 according to the invention, whose switch slide 1 is provided with the heart cam 3. The detent slides 17 and the associated stops 34 for each individual switch 41 to be inserted, are mounted on a common rail 42 designed as a cross slide, or consists, together therewith, of one single component part which may be either e.g., an injection-molded part or a molded article. The compression spring 30 is clamped between a stop member 43 of either the rail 42 or the stop 34 and the housing 13 of a switch 41. The stops 34 are of hook-shaped design and extend from the rail 42 (cross slide) to the detent pin 8 on the top side of the switch 41.

The rail (or cross slide) 42 is guided by an interspace provided for between the bottom side of the switch housing and the bottom 44 of the U-shaped frame 40, as well as by the side walls of the U-shaped frame 40. In such or a similar frame 40 there may also be provided switches 41 to which there is assigned a detent slide 44 which is not coupled to the rail 42, or which is only supposed to perform the function of a pushbutton switch.

If so required, it is possible that also additional functions can be performed by the detent rail 17 or the rail 42 during the switching on and/or the over-travel, such as the actuation of an additional switch, for example, for an indicating lamp and/or for a mechanical indication, such as a drop indicator or diaphragm, etc.

What is claimed is:

1. An electrical pushbutton switch assembly comprising, in combination:

a housing;

a switch slider mounted in said housing for reciprocal motion therein, said slider having a generally heart-shaped cam in a first surface of said slider;

a detent pin extending through said housing and into said cam and said cam having a plurality of curved paths for receiving and guiding said detent pin therein;

a return spring resiliently urging said slider in a direction away from said housing;

a detent profile provided in a surface of said slider adjacent to said first surface with said detent profile defining latched and released slider positions; and, a detent bar movably mounted adjacent to said housing for reciprocal motion in a direction perpendicular to the direction of motion of said slider, said detent bar being resiliently biased toward said detent profile, said detent bar having a first projection extending into and engaging said detent profile, and said detent bar having a second projection extending toward and engaging said detent pin thereby to move said detent bar in response to relative movement of said detent pin with respect to said cam when the relative movement of said detent pin is along a selected one of said curved paths, whereby said detent pin moves said first projection away from said detent profile when the relative movement of said detent pin is along said selected curved path and toward the released slider position.

* * * * *